US008569724B2

(12) United States Patent
McGeoch

(10) Patent No.: US 8,569,724 B2
(45) Date of Patent: Oct. 29, 2013

(54) INDUCTION HEATED BUFFER GAS HEAT PIPE FOR USE IN AN EXTREME ULTRAVIOLET SOURCE

(75) Inventor: Malcolm W. McGeoch, Little Compton, RI (US)

(73) Assignee: Plex LLC, Fall River, MA (US)

( * ) Notice: Subject to any disclaimer, the term of this patent is extended or adjusted under 35 U.S.C. 154(b) by 133 days.

(21) Appl. No.: 13/326,043

(22) Filed: Dec. 14, 2011

(65) Prior Publication Data

US 2013/0153568 A1 Jun. 20, 2013

(51) Int. Cl.
*H05G 2/00* (2006.01)

(52) U.S. Cl.
USPC ..... 250/504 R; 250/493.1

(58) Field of Classification Search
USPC ..... 219/672, 671, 673–677, 624, 630, 635; 250/504 R, 493.1, 492.2, 238, 429, 239, 250/354.1, 372, 423 P, 428, 432 R, 435, 436, 250/492.1, 503.1, 505.1, 515.1; 355/30, 67, 355/53, 52, 69, 77, 133, 55, 56, 72, 75; 359/845, 838, 871, 350, 511, 819; 378/34, 119, 138, 143; 134/1.1, 26, 18, 134/19, 22.1, 30, 35, 37, 94.1; 372/55, 87, 372/25; 430/311, 5, 30, 403
See application file for complete search history.

(56) References Cited

U.S. PATENT DOCUMENTS

| | | | | |
|---|---|---|---|---|
| 7,479,646 | B2 * | 1/2009 | McGeoch | 250/504 R |
| 2009/0212241 | A1 | 8/2009 | Mcgeoch | |
| 2011/0089834 | A1 | 4/2011 | Mcgeoch | |

OTHER PUBLICATIONS

C.R. Vidal et al., "Heat-Pipe Oven: A New, Well-Defined Metal Vapor Device for Spectroscopic Measurements", J. Appl. Phys., vol. 40, No. 8, Jul. 1969, pp. 3370-3374.
G.M. Grover et al., "Structures of Very High Thermal Conductance", J. Appl. Phys., vol. 35, 1964, pp. 1990-1991.
Boyd et al., "Disk-shaped heat-pipe oven used for lithium excited-state lifetime measurements", Optics Letters, vol. 5, No. 3, Mar. 1980, pp. 117-119.

* cited by examiner

*Primary Examiner* — Michael Maskell
(74) *Attorney, Agent, or Firm* — Wolf, Greenfield & Sacks, P.C.

(57) ABSTRACT

The successful use of lithium vapor in an extreme ultraviolet (EUV) light source depends upon an intense localized heat source at the center of conical structures that evaporate, condense and re-supply liquid lithium. Induction heating of a hollow structure with toroidal topology via an internal helical field coil, can supply intense heat at its innermost radius. The resulting slim radio frequency heated structure has high optical transmission from a central EUV producing plasma to collection mirrors outside of the structure, improving EUV source efficiency and reliability.

9 Claims, 4 Drawing Sheets

FIGURE 1, parts A and B

FIGURE 3, parts A and B

INDUCTION HEATED BUFFER GAS HEAT PIPE FOR USE IN AN EXTREME ULTRAVIOLET SOURCE

BACKGROUND

An extreme ultraviolet (EUV) light source based on a discharge within a wide-angle buffer gas heat pipe has been disclosed by McGeoch [1]. In addition, other wide-angle heat pipe EUV source designs have been disclosed [2,3,4] in all of which the heat pipe structures must be thin in order to transmit the maximum amount of EUV light. Intense heat of up to several kW has to be applied at the smallest inside radius of the conical or disc-shaped heat pipe structures, to evaporate lithium from a location as close as possible to where it is needed for the discharge, yet allow its out-board re-condensation at as small a radius as possible. Very thin and compact heater structures are therefore necessary. In prior work on metal vapor heat pipes in which the constraints are not so demanding, the source of heat has variously been one of: induction heating of the outside of a cylinder via a field coil [5,6]; resistance wire in an insulator [1]; electron beams; or a flame [7]. As the geometry moves from a cylinder [5] to a disc [7] to three-dimensional [1], the heating problem becomes more acute. Although one could consider laser heating, it has the disadvantages of requiring a complex optical distribution system, and high cost.

SUMMARY OF THE INVENTION

Induction heating via a helical coil within a distorted toroidal shell can deliver very high power within a thin structure. A heating element using this principle is illustrated in FIG. 1, parts A and B. Using several elements similar to that shown in FIG. 1A complete three-dimensional metal vapor containment system may be built up, as illustrated for example in FIG. 2. In order to provide efficient outward transmission of light generated by a discharge in the metal vapor, the surface shapes of the distorted toroidal shells may be substantially conical. Each of these conical structures may be electrically isolated from the others via a transformer that couples the radio frequency power, with the consequence that a high current pulsed electrical discharge may be driven between any two such structures, for instance between the anode and cathode of an EUV-producing discharge configuration.

It is well known that radio frequency power deposits heat into a thin surface layer of a conducting medium. This principle is used in many heating applications. The depth to which radio frequency power penetrates is defined by the "skin depth" δ, with the current falling off with depth d below the surface as $$J=J_s\exp(-d/\delta)$$

In normal cases δ (in metres) is well approximated as $$\delta=\sqrt{\frac{\rho}{\pi f\mu_0\mu_r}}$$

where ρ is the resistivity of the conductor in Ωm, f is the frequency of the current in Hz, $\mu_0$ is the permeability of free space and $\mu_r$ is the relative permeability of the conductor.

In the present invention radio frequency power is trapped inside a structure of toroidal topology by virtue of a "skin depth" that is substantially smaller than the thickness of the structure's surface material. Several of these structures make up a typical heat pipe as shown for example in FIG. 2, which is a cross section of four such structures that have a vertical axis of rotational symmetry. Any one structure is not necessarily a perfect torus which would have circular cross section at any point around its form, but typically is very much flattened near its center while sharing the same topology as a torus. Within this structure of toroidal topology a helical radio frequency coil acts as the primary of a step-down transformer for which the secondary is the single turn loop formed by the radial section of the structure, as illustrated in FIG. 1, parts A and B.

DETAILED DESCRIPTION

Figure 1A:
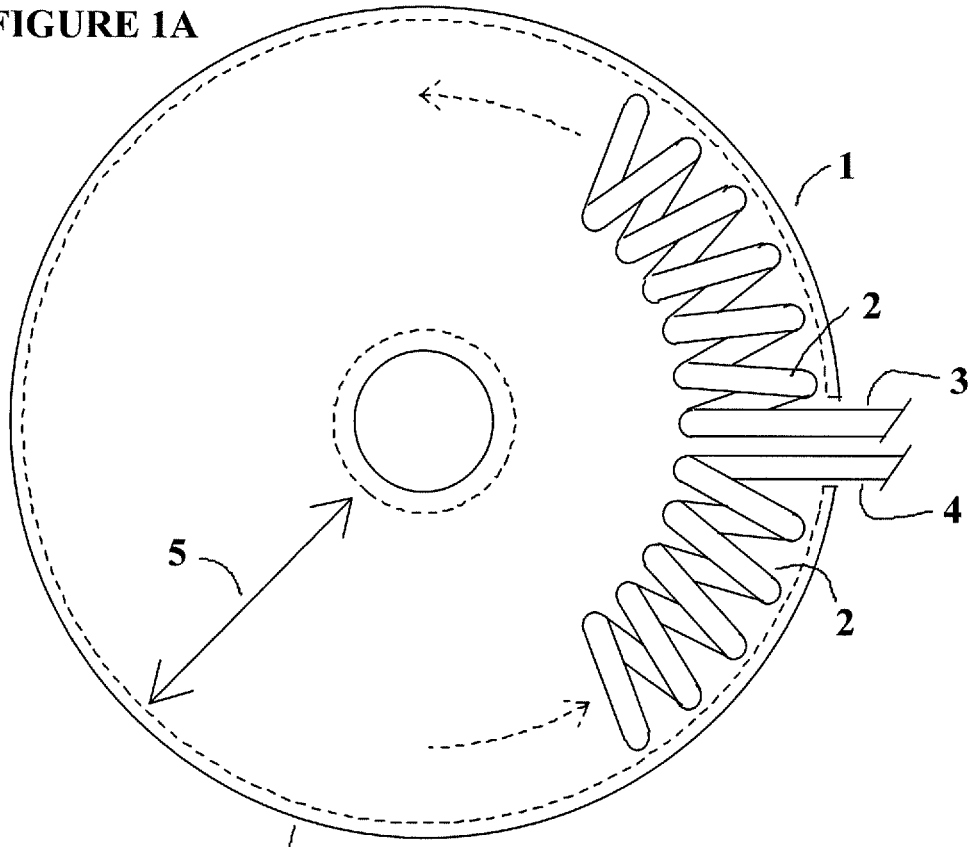
FIG. 1A is a plan view of a structure of toroidal topology containing a multiple-turn radio frequency field coil.
Figure 1B:
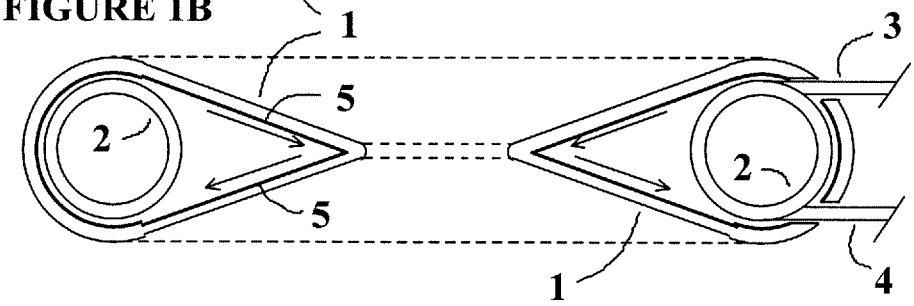
FIG. 1B is a cross section of the structure of FIG. 1A.

Operation of the typical induction-heated structure is described with reference to FIG. 1, parts A and B. FIG. 1B is a cross section through the plan view of FIG. 1A. The shell 1 of the hollow structure is tapered in cross section toward a central hole. Each side of the shell may have a conical shape for optimum transmission of extreme ultraviolet light produced at a central point, hence the structures are referred to generically as "conical" structures. Within shell 1 is disposed a helical coil 2 that carries radio frequency power introduced via input and output leads 3 and 4. Power in coil 2 at a frequency high enough to give a "skin depth" less than the wall thickness of shell 1, induces a circulating current 5 on the inside of the wall that flows around a radial cross section of shell 1. The resistive heating of current 5 is maximized at the innermost radius of the shell because the cross section through which the current has to flow is smallest at that inside location. As the temperature at the inner location rises, in most materials of interest, there is an increase of resistivity that further enhances the rate of heating there. Materials of interest for the walls of shell 1 include, but are not limited to, the lithium-resistant metals and alloys molybdenum, stainless steel and iron. As an example of the parameters of interest, a radio frequency power in excess of 1 kW at a frequency in the range 100 kHz to 1 MHz may be applied between leads 3 and 4. In steady operation there is a cooling circuit near the outermost radius of the shell that establishes a steady balance between heat that is delivered mostly at the inner edge of the structure and removal of heat at the cooling location near the outer edge of the structure. In this manner a steep temperature gradient can be established and maintained as required for the re-evaporation of a metal vapor at the smallest radius, and its condensation at an intermediate radius.

Figure 2:
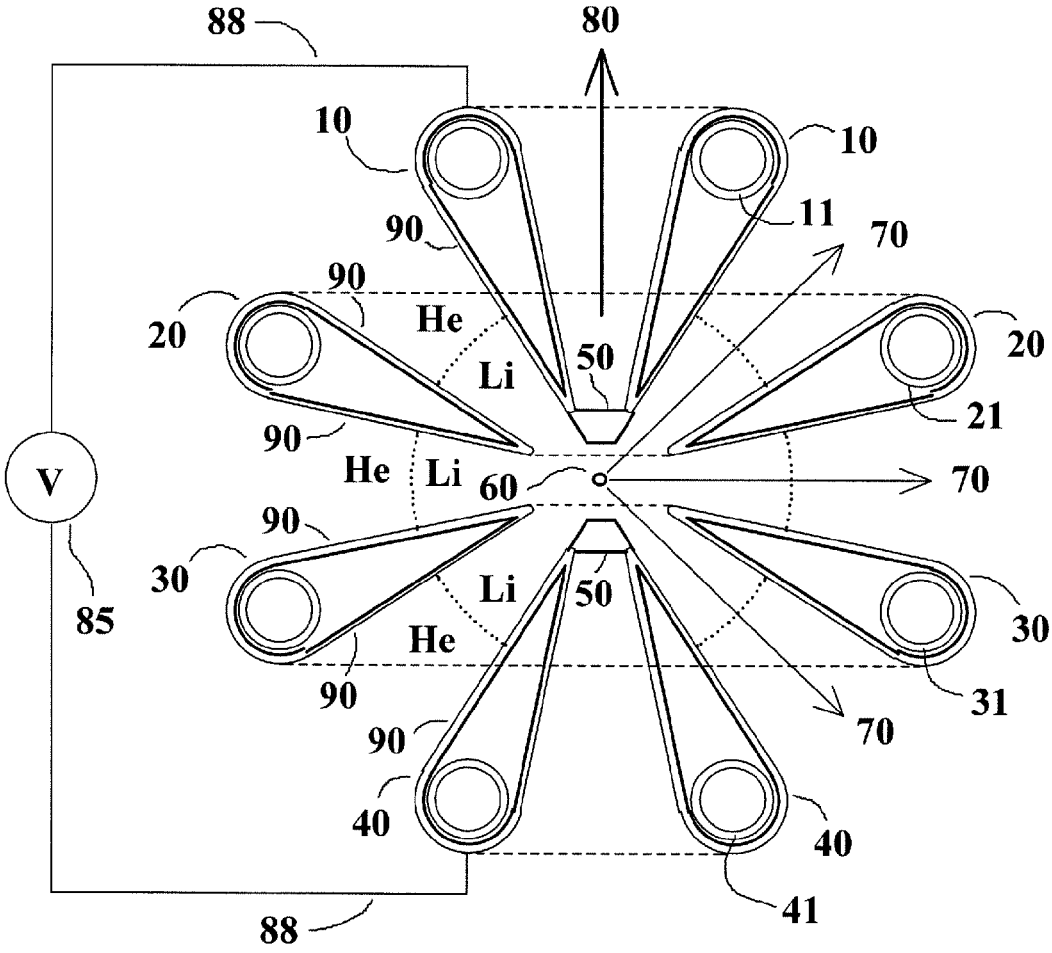
FIG. 2 is a cross section of a heat pipe assembly of four structures of toroidal topology, where there is a vertical axis 80 of rotational symmetry.

In FIG. 2 an example of a full heat pipe assembly is shown comprising four structures of the type illustrated in FIG. 1. Operation of the heat pipe is described with reference to FIG. 2 as follows:

In order to understand the disposition of the structures, note that vertical axis 80 is an axis of rotational symmetry for the assembly. Four structures, 10, 20, 30, 40 are shown in cross section. They are immersed in a low pressure gas buffer (typically in the range 1 to 5 torr). In the case of lithium operation of the heat pipe the preferred gas buffer is helium. Within each structure there is a radio frequency coil, denoted by 11, 21, 31, 41 respectively. The top and bottom structures 10 and 40 each have an electrode structure 50 that closes their central hole. The electrode structures 50 may be of many different types, according to the mode of operation of the discharge apparatus. Voltage supply 85 is connected via leads 88 to heat pipe structures 10 and 40, to power a discharge between electrode structures 50.

In operation, radio frequency power is applied to helical coils 11, 21, 31, 41 to drive an induction current on the inside wall of each of structures 10, 20, 30, 40. Lithium metal on the surfaces 90 of each structure is evaporated and establishes an equilibrium boundary with the helium gas buffer. In operation of the heat pipe as an EUV source, the voltage source 85 drives a current between electrodes 50 that ionizes and pinches lithium vapor, to reach a plasma density exceeding $10^{18}$ electrons $cm^{-3}$, when hydrogen-like lithium emission at 13.5 nm is emitted from plasma spot 60. EUV light rays 70 depart via the tapered gaps between the structures, to be collected by mirrors and used at a remote location. Plasma exhaust particles are condensed on the cooler outboard parts of surfaces 90, to flow back to the hotter central region of surfaces 90 for re-evaporation. Surfaces 90 may carry radial grooves to aid the return flow of lithium, or may carry a mesh to aid the return flow of lithium, as is well documented in metal vapor heat pipe technology.

Figure 3A:
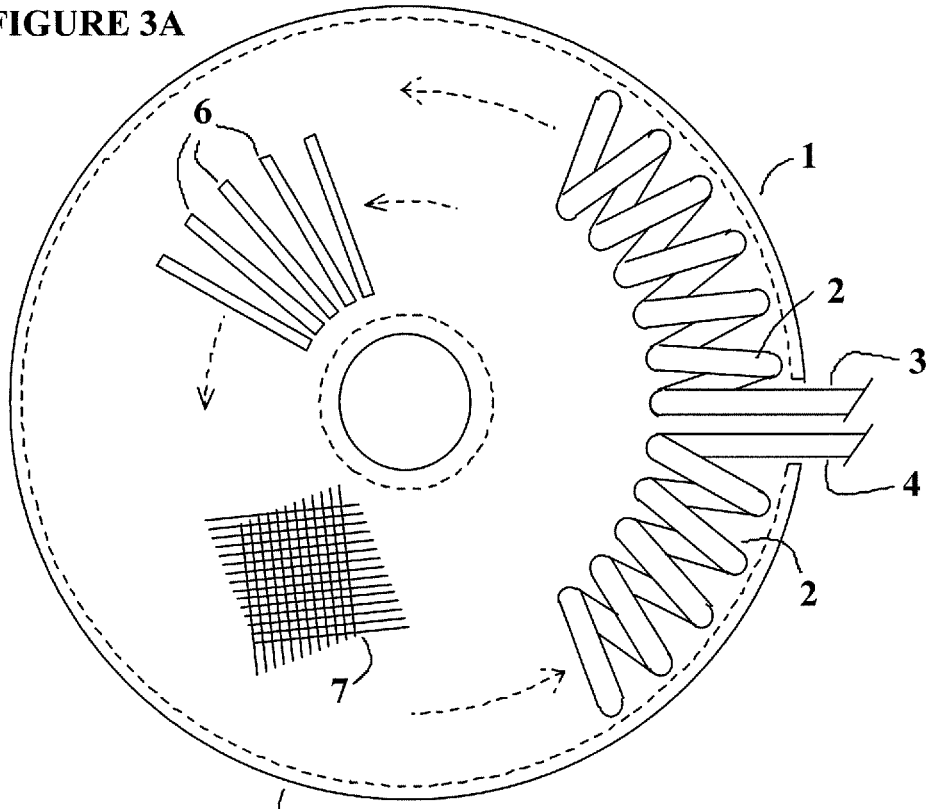
FIG. 3A is a plan view of a structure of toroidal topology with grooves and/or meshes on its outer surfaces.
Figure 3B:
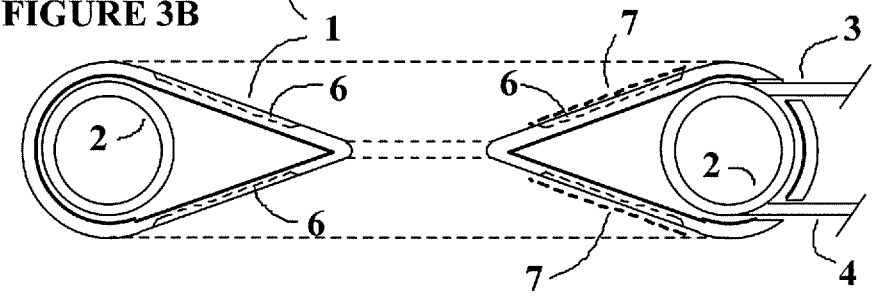
FIG. 3B is a cross section of the structure of FIG. 3A.

FIG. 3, parts A and B shows the disposition of grooves 6, and meshes 7, that aid the return flow of lithium. The grooves are aligned radially and do not penetrate through the whole depth of shell 1. Meshes 7 may either be attached to a surface without grooves, or be added above grooves 6 to operate in tandem with them.

Figure 4:
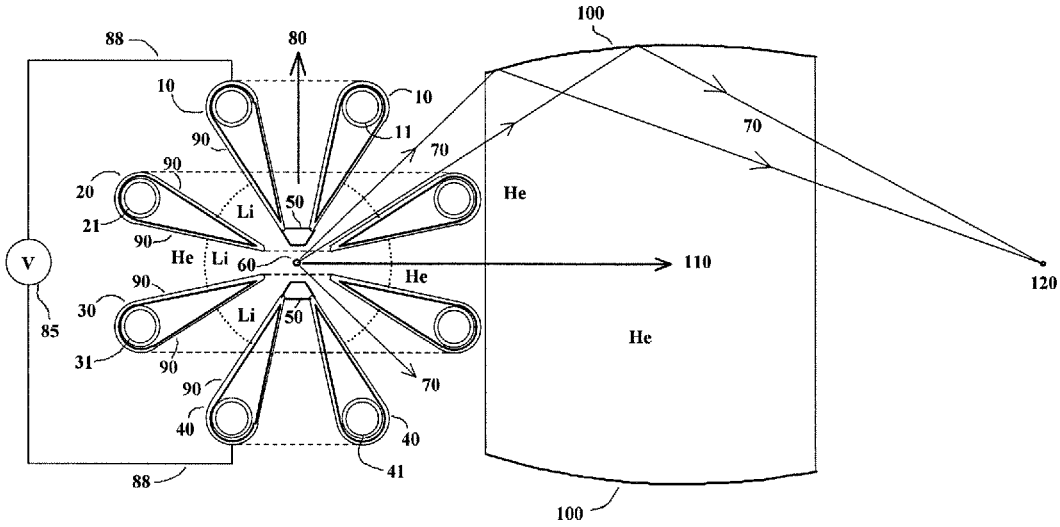
FIG. 4 illustrates use of the induction heated heat pipe in an extreme ultraviolet light source system.

FIG. 4 illustrates use of the heat pipe in an extreme ultraviolet (EUV) light source system. In that figure, the four-structure heat pipe of FIG. 2 has a helium fill and contains lithium gas when radio frequency heating is applied. Note that the heat pipe structure has rotational symmetry around vertical axis 80. An ellipsoidal collector optical element 100, with rotational symmetry about axis 110, perpendicular to axis 80, collects rays 70 of EUV light emitted by discharge plasma 60, and reflects them toward focal point 120.

In a realization of the invention, radio frequency power in the frequency range 100 kHz to 1 MHz has been applied to the internal field coils of a heat pipe with four of the subject structures, to deliver a total power exceeding 4 kW. A pulsed current of between 5 kA and 20 kA has been applied via voltage supply 85 to two of the structures, to generate 160 mJ/mm of EUV light from a linear Z-pinch discharge between electrodes 50. The electrical pulse duration was 1-2 microseconds and the repetition frequency was as high as 2 kHz.

Many variations of the shape of this basic heat pipe topology are included in the invention. For example, thinner and more numerous structures may be used as plasma power is increased, to effectively trap plasma particles and re-supply the central region with lithium gas.

REFERENCES

1. M. McGeoch, U.S. Pat. No. 7,479,646, Jan. 20, 2009. "Extreme Ultraviolet Source with Wide Angle Vapor Containment and Reflux".
2. M. McGeoch, US Patent application "Laser Heated Discharge Plasma EUV Source", filed Nov. 25, 2008.
3. M. McGeoch, US Patent application "Z-Pinch Plasma Generator and Plasma Target", filed Aug. 11, 2010.
4. M. McGeoch, US Patent application "Pulsed Discharge Extreme Ultraviolet Source with Magnetic Shield", filed Dec. 9, 2010.
5. C. R. Vidal and J. Cooper, "Heat-Pipe Oven: A New, Well-defined Metal Vapor Device for Spectroscopic Measurements", J. Appl. Phys. 40, 3370-3374 (1969).
6. G. M. Grover, T. P. Cotter and G. F. Erickson, "Structures of very high thermal conductance", J. Appl. Phys. 35, 1990-1991 (1964).
7. R. W. Boyd et al., "Disk-shaped heat pipe oven used for lithium excited-state lifetime measurements", Optics Letters 5, 117-119 (1980).

Further realizations of this invention will be apparent to those skilled in the art. Having thus described several aspects of at least one embodiment of this invention, it is to be appreciated that various alterations, modifications, and improvements will readily occur to those skilled in the art. Such alterations, modifications and improvements are intended to be part of this disclosure, and are intended to be within the spirit and scope of the invention. Accordingly, the foregoing description and drawings are by way of example only.

What is claimed is:

1. A buffer gas heat pipe for the containment of metal vapor comprising a plurality of hollow disc-shaped or conical structures of toroidal topology collectively immersed in a buffer gas, each structure containing an internal helical coil powered by a radio-frequency current to induce a skin effect heating current that flows in loops defined by radial sections of the structure, with the most intense delivery of heat at the least radius of the structure.

2. A buffer gas heat pipe as in claim 1 in which the buffer gas is helium and the metal is lithium.

3. A buffer gas heat pipe as in claim 1 in which the skin depth of penetration of the radio-frequency power is less than the wall thickness of the hollow disc-shaped or conical structures.

4. A buffer gas heat pipe as in claim 2 in which at least part of the wall of each of the hollow structures is composed of a lithium-resistant metal, including but not confined to molybdenum, stainless steel or iron.

5. A buffer gas heat pipe as in claim 1 in which the external surface of the hollow disc-shaped or conical structures has grooves disposed radially in order to aid the return flow of condensed metal to a hotter, more central location where it re-evaporates.

6. A buffer gas heat pipe as in claim 1 in which the external surface of the hollow disc-shaped or conical structures has meshes in order to aid the return flow of condensed metal to a hotter, more central location where it re-evaporates.

7. A buffer gas heat pipe as in claim 1 in which two or more of the disc-shaped or conical structures are connected electrically to the output terminals of a pulsed power supply that drives an electrical discharge in the metal vapor.

8. A buffer gas heat pipe as in claim 7 in which the electrical discharge in the metal vapor induces a plasma pinch of sufficiently high temperature to radiate extreme ultraviolet or soft X-ray light.

9. An extreme ultraviolet source system comprising a buffer gas heat pipe discharge as in claim 8 and a reflecting light collector to re-direct extreme ultraviolet light emitted by the discharge to a distant focal point for use in an application.

* * * * *